United States Patent [19]

Lodovico et al.

[11] Patent Number: 4,750,678

[45] **Date of Patent: * Jun. 14, 1988**

[54] METHOD AND APPARATUS FOR CUTTING DISPOSABLE CONTAINERS

[75] Inventors: Frank J. Lodovico, Delmont, Pa.; John W. Wagner, 3321 McIntyre Dr., Murrysville, Pa. 15668

[73] Assignee: John W. Wagner, Murrysville, Pa.

[ * ] Notice: The portion of the term of this patent subsequent to Mar. 8, 2005 has been disclaimed.

[21] Appl. No.: 9,465

[22] Filed: Feb. 2, 1987

Related U.S. Application Data

[60] Division of Ser. No. 742,999, Jun. 9, 1985, Pat. No. 4,669,673, which is a continuation-in-part of Ser. No. 646,917, Sep. 4, 1984, abandoned.

[51] Int. Cl.[4] ..... B02C 19/14

[52] U.S. Cl. ..... 241/29; 241/99

[58] Field of Search ..... 100/902, 96, 172; 194/208, 209; 83/500–504, 345; 241/99, 236, 166, 167, 36, 37.5, 222, 224, 225, 158, 152 A, 160, 29

[56] References Cited

U.S. PATENT DOCUMENTS

| | | | |
|---|---|---|---|
| 3,489,354 | 1/1970 | Harper et al. | 241/99 X |
| 4,009,838 | 3/1977 | Tashman | 241/236 X |
| 4,018,392 | 4/1977 | Wagner | 241/236 X |
| 4,285,426 | 8/1981 | Cahill | 241/99 X |
| 4,355,765 | 10/1982 | Parker et al. | 241/158 X |

FOREIGN PATENT DOCUMENTS

| | | | |
|---|---|---|---|
| 2514432 | 10/1976 | Fed. Rep. of Germany | 241/236 |
| 2526650 | 12/1976 | Fed. Rep. of Germany | 241/236 |
| 1558423 | 1/1980 | United Kingdom | 241/236 |

*Primary Examiner*—mark Rosenbaum

*Attorney, Agent, or Firm*—James L. Sherman

[57] ABSTRACT

A machine is capable of cutting into pieces disposable containers such as plastic bottles and metal cans. A first cutting section includes a pair of parallel shafts mounted for rotation in opposite directions. Each of the shafts supports a plurality of cutting wheels keyed for rotation therewith. The cutting wheels of one shaft overlap the cutting wheels on the other shaft as each cutting wheel is axially separated from axially adjacent cutting wheels thereon by one of the cutting wheels on the other shaft. A comber is aligned with each cutting wheel to provide a gap between the cutting teeth and the end of the comber. The disposable containers are cut into first pieces between the cutting wheels of one shaft and the cutting wheels of the other shaft. The first pieces from the first cutting section pass to a second cutting section to be cut into smaller, second pieces. The invention also includes the method of cutting the disposable containers in pieces.

4 Claims, 3 Drawing Sheets

METHOD AND APPARATUS FOR CUTTING DISPOSABLE CONTAINERS

CROSS REFERENCE TO RELATED APPLICATION

This application is a division of application Ser. No. 742,999, filed June 10, 1985, now issued on June 2, 1987 as U.S. Pat. No. 4,669,673, which is a continuation-in-part of application Ser. No. 646,917, filed Sept. 4, 1984, now abandoned.

BACKGROUND OF THE INVENTION

1. Field of the Invention

This invention relates to method and apparatus for cutting disposable containers such as plastic bottles or metal cans into small pieces.

2. Description of the Prior Art

Recent legislation regulating the collection and disposition of disposable containers such as plastic bottles and metal cans in the soft drink industry has resulted in increased interest in machines that can be employed to reduce the size of the used containers to simplify handling and storage. Three machines respectively disclosed in U.S. Pat. Nos. 3,857,334; 4,009,838; and 4,285,426 represent specific devices intended to satisfy specific needs in this regard.

However, there remains a need for any reliable and versatile machine configuration which can be equally employed to cut the sheet plastic or sheet metal material of the disposable containers. Paper shredding machines include a general configuration which might appear to satisfy such a need but would not normally include sufficiently strong components or be properly configured for such a heavy-duty operation. Nevertheless, paper shredding machines such as those disclosed in U.S. Pat. Nos. 1,178,386; 1,319,496; 2,202,843; 2,554,114; 2,770,302; 3,797,765; and 4,018,392, include a general arrangement of rotating cutters and stationary combers which could be appropriate for this purpose. Clearly, the particular components to be used in such a machine should be simple to manufacture and easy to assemble. Further, it would be advantageous if the machine configuration could be employed for any number of purposes, such as within machines to be operated by consumers, machines to be operated by store personnel, or machines to be operated at waste control centers.

SUMMARY OF THE INVENTION

It is, therefore, an object of this invention to provide a machine capable of cutting into pieces a plurality of disposable containers such as plastic bottles and metal cans.

It is another object to provide such a machine with components which are simple to manufacture, easy to assemble and reliable to operate.

It is a further object to provide such a machine with a general configuration which can be employed on different size machines which clearly satisfy different needs.

These and other objects of the invention are provided in a preferred embodiment thereof including a machine capable of cutting into pieces a plurality of disposable containers such as plastic bottles and metal cans. The machine includes a loading section for receiving the disposable containers and a cutting section joined to the loading section at an entrance opening for receiving the containers therefrom. The cutting section includes a pair of parallel shafts mounted for rotation in opposite directions. The pair of shafts each support a plurality of cutting wheels keyed for rotation therewith. The pair of shafts are separated by a distance therebetween which is less than a diameter of the cutting wheels thereon. Each cutting wheel is mounted for axial movement on one shaft and is axially separated from axially adjacent cutting wheels thereon by one cutting wheel on the other shaft extending therebetween. The cutting section includes a plurality of combers which are each aligned with a corresponding cutting wheel to provide a gap between an end thereof and the cutting teeth of the corresponding cutting wheel. The plurality of cutting wheels on the pair of shafts are rotated to grip the disposable containers to be directed between the cutting wheel on one shaft and the cutting wheel on the other shaft as the pieces pass through the gaps between the ends of the combers and the cutting teeth of the corresponding cutting wheel. A collecting section adjoins the cutting section for receipt of pieces of disposable containers leaving the cutting section.

In another embodiment of the invention, a machine for cutting at least one disposable container includes a first cutting section having an inlet for the receipt of the disposable container therein. The first cutting section includes a pair of parallel shafts mounted at opposite sides of the inlet for rotation in opposite directions. The pair of shafts each supports a plurality of cutting wheels keyed for rotation therewith. The shafts are separated by a distance therebetween which is less than a diameter of the cutting wheel. Each cutting wheel is axially separated from axially adjacent cutting wheels thereon by one of the cutting wheels on the other shaft extending therebetween. Each cutting wheel has a plurality of cutting teeth thereon. The first cutting section includes a plurality of combers with each comber being aligned with a corresponding cutting wheel to provide a gap between an end thereof and the cutting teeth of the corresponding cutting wheel. The cutting wheels rotate to grip the disposable container therebetween to cause it to be directed between the cutting wheels of the one shaft and the cutting wheels of the other shaft and cut into first pieces. A second cutting section is mounted below the first cutting section to receive the first pieces therefrom to be further cut into pieces into smaller second pieces.

There is also provided a method of cutting disposable containers including gripping the disposable container with the cutting teeth of oppositely rotating, overlapping cutting wheels. The teeth of the cutting wheels cut the container into pieces with the pieces being maintained closely to the cutting teeth until fully cut from the container.

DESCRIPTION OF THE PREFERRED EMBODIMENTS

Figure 3:
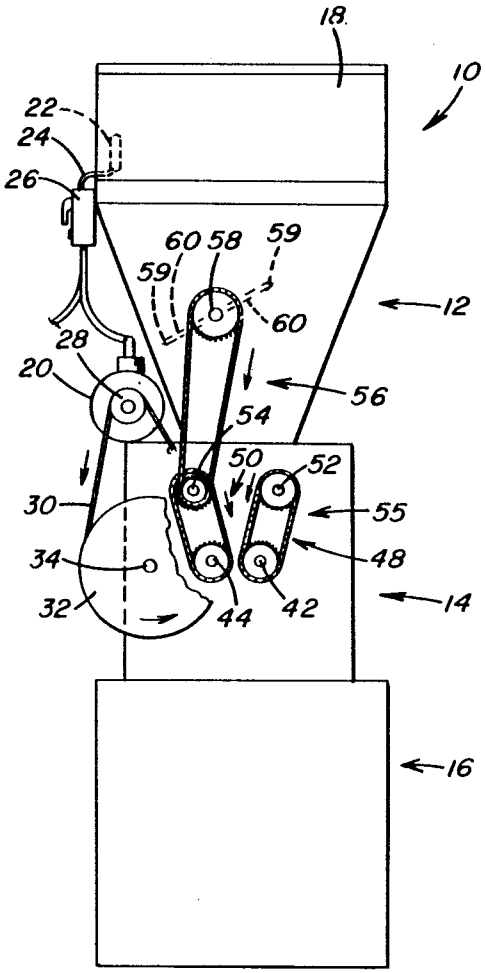
FIG. 3 is an elevational view of the opposite side of the machine in FIG. 1.
Figure 2:
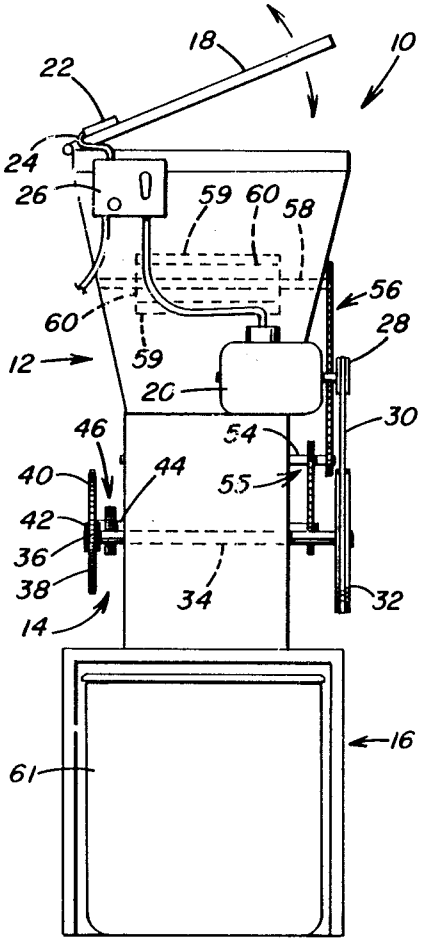
FIG. 2 is a front elevational view of the machine of FIG. 1.
Figure 1:
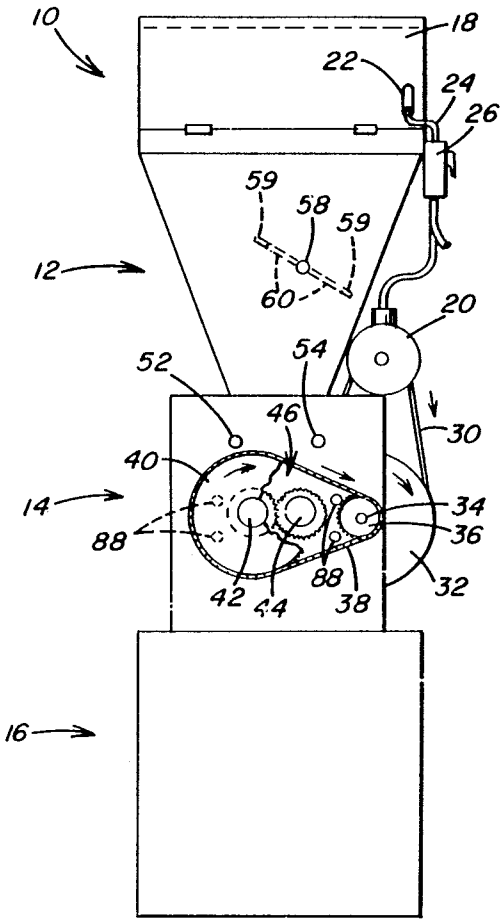
FIG. 1 is a side elevational view of the preferred machine including various features of the invention.

As seen in FIGS. 1, 2 and 3, the preferred machine 10 for cutting disposable containers such as plastic bottles and metal cans primarily includes a loading section 12, a cutting section 14, and a collecting section 16. The preferred machine 10 is the type which can be utilized in grocery or convenience stores to reduce the volume of disposable container material to be handled or stored by store personnel until removed by waste or scrap dealers. The machine 10, shown without cover panels and shields in order to see various operating components, includes features which are particularly adapted for such a use. For example, it basically employs gravity flow, includes operator accessable loading section 12 and collecting section 16, and incorporates safety features associated with the loading section 12 to ensure against any injury or harm to the operator.

Specifically, the loading section 12 is funnel-shaped and includes a closable top 18 which, when open, allows approximately thirty 2-liter disposable plastic bottles to be put in the interior of the section 12. Operation of the machine motor 20 is prevented whenever the top 18 is open by a safety switch 22 mounted on the top 18. Specifically, the switch 22 is a mercury-type switch which is only closed to allow current to flow therethrough when in a horizontal position. The top 18 is mechanically prevented from being positioned horizontally except in the closed position and the safety switch 22 is connected by wiring 24 to a motor controller 26 in a manner well known in the electrical motor control art to prevent any operation of the motor 20 unless access to the interior of the loading section 12 is prevented.

The motor 20 provides basic power for operating the entire machine 10 through a drive pulley 28. A belt 30 connects the drive pulley 28 to a larger, driven pulley 32 which is mounted on a transfer shaft 34 having a chain drive sprocket 36 on the other end thereof. The drive sprocket 36 is connected by a chain 38 to a larger sprocket 40 which directly drives one of a pair of main shafts 42 and 44. The main shafts 42, 44 are primarily used to cut the containers in a manner which will be explained in detail hereinbelow. They are parallel and mounted for rotation in opposite directions, and in the preferred configuration, the shafts 42, 44 extend horizontally and are located at the same horizontal level within the machine 10. To cause shaft 44 to rotate in the opposite direction of shaft 42 but at the same speed as shaft 42, they are geared together at 46.

The main shafts 42, 44 have sprocket and chain means 48, 50 respectively mounted on the opposite ends thereof in order to be able to transmit corresponding rotation to a pair of feeding shafts 52, 54 of a feeding assist means 55 which will also be discussed in detail hereinbelow. Finally, a single chain and sprocket means 56 is employed to impart rotation to an agitation shaft 58 which supports agitator paddles 60. The rotating agitator paddles 60 are capable of stirring the containers in the loading section 12 to insure they will be properly delivered to the cutting section 14. Although the paddles 60 may be made of sheet metal, it is possible for the outer edges 61 to be partially made of rubber material to insure that the containers will not be entrapped against the interior wall of the loading section 12.

The collecting section 16 is below the cutting section 14 and joined thereto to receive pieces of the disposable containers as they pass by gravity from the cutting section 14. The collecting section 16 is enclosed on three sides but includes a removable basket 61 to collect the pieces for it to be periodically emptied by the machine operators. As thus described, the preferred machine 10 includes dimensions and an arrangement of components which are particularly appropriate for use in grocery and convenience stores.

Figure 4:
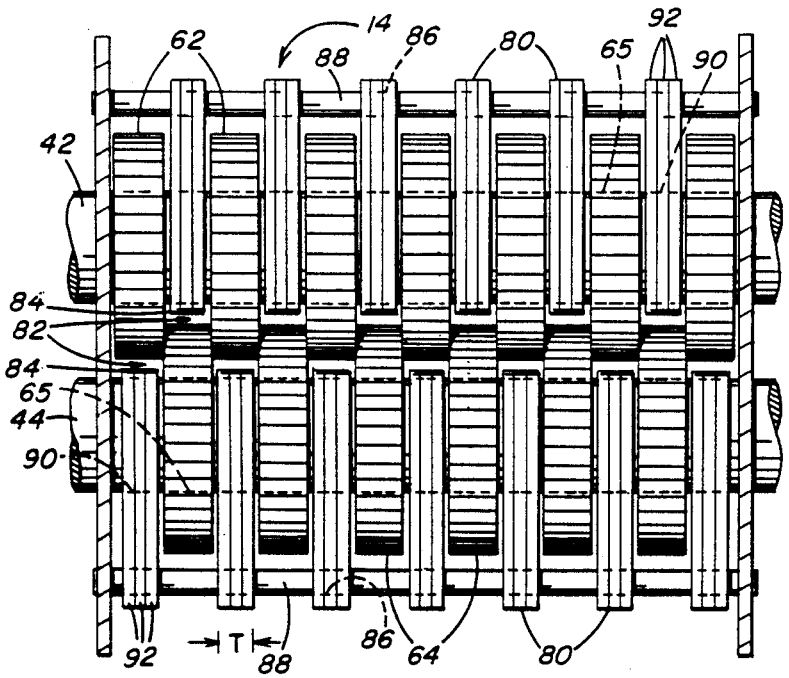
FIG. 4 is a fragmentary top view of the cutting section of the machine of FIG. 1.
Figure 5:
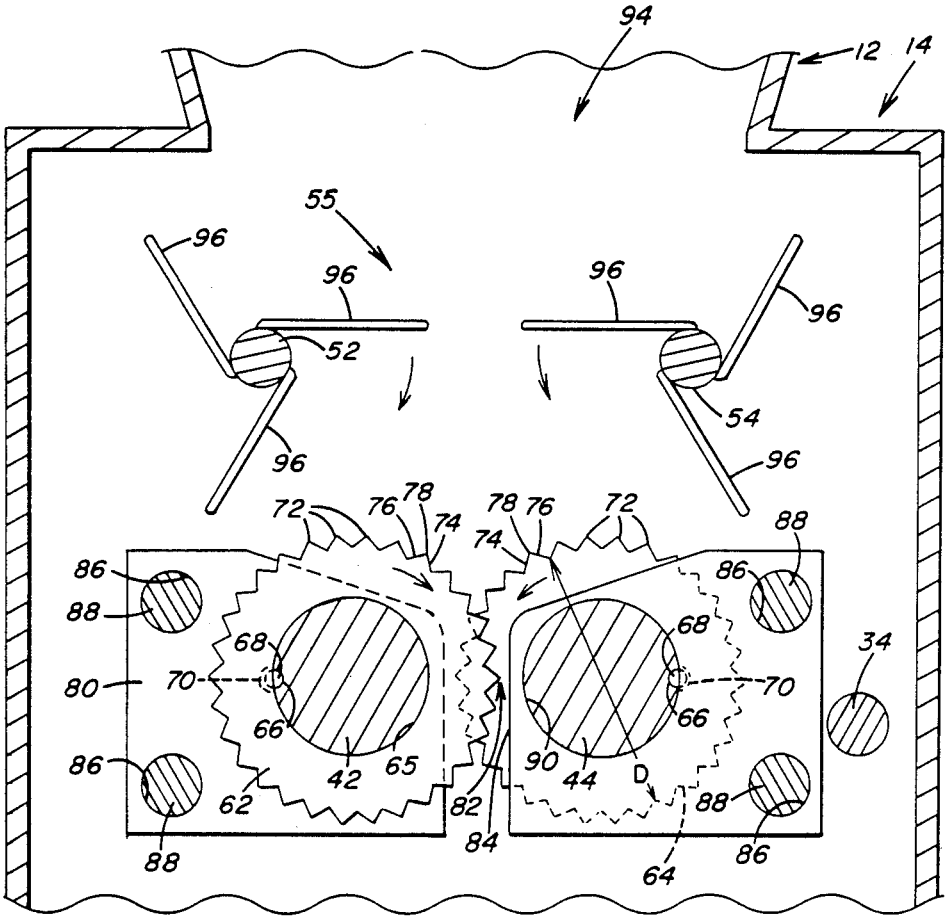
FIG. 5 is simplified end view of the cutting section of FIG. 4 including various features of the invention.
Figure 8:
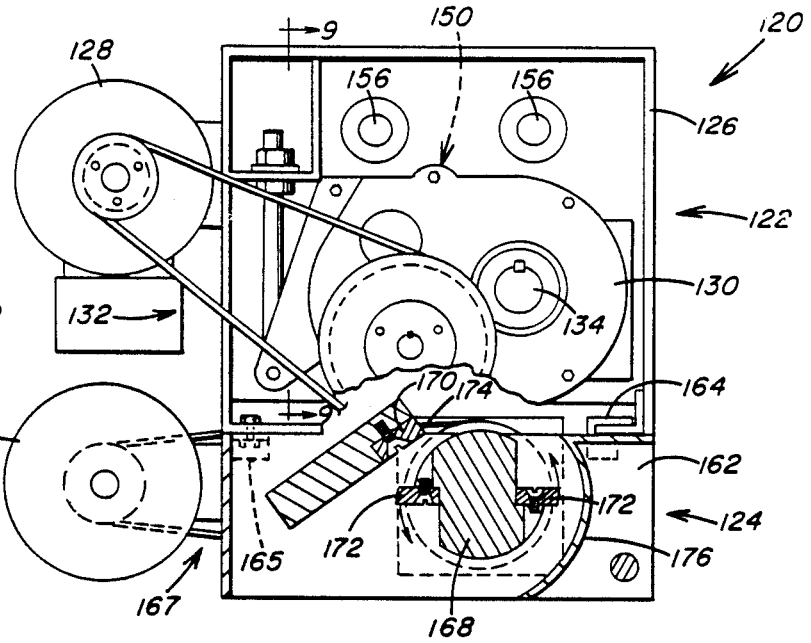
FIG. 8 is a end elevational view partially in section of another embodiment of the invention.
Figure 10:
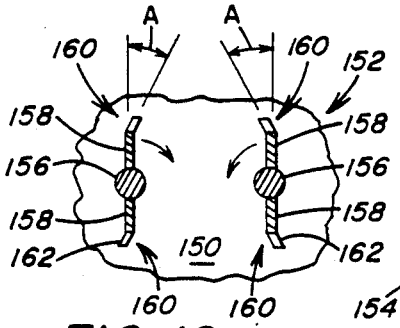
FIG. 10 is a view as seen along line 10—10 of FIG. 9.
Figure 9:
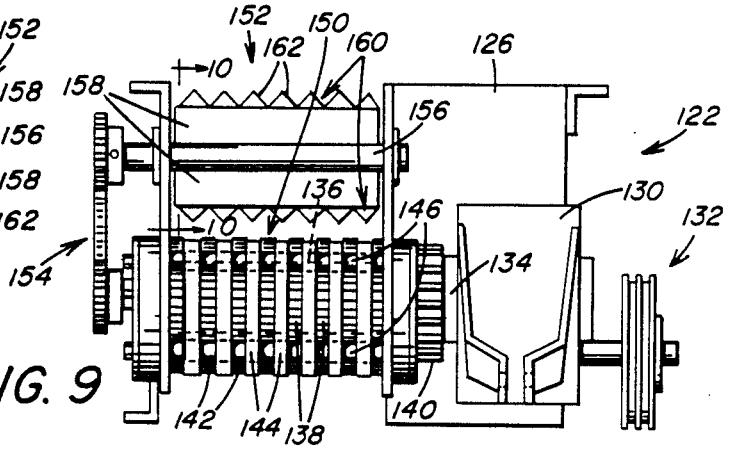
FIG. 9 is a view of the embodiment of FIG. 8 as seen along line 9—9.
Figure 11:
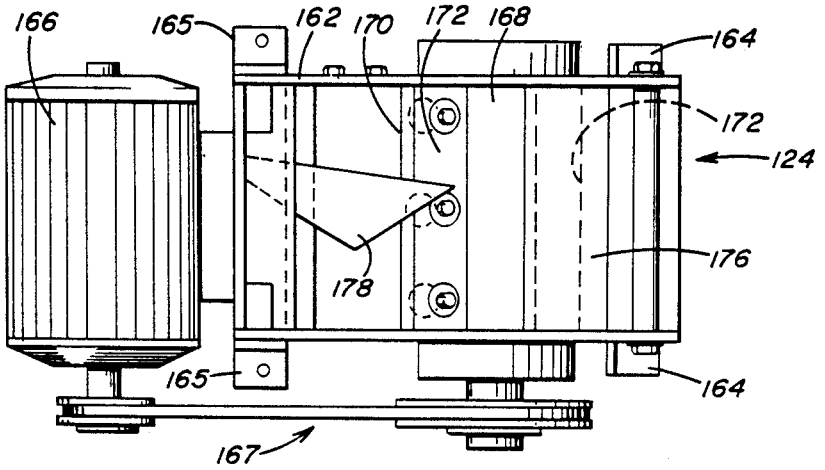
FIG. 11 is a bottom view of the embodiment shown in FIG. 8.

As seen in FIGS. 4 and 5, the preferred cutting section 14, includes a plurality of cutting wheels 62, 64 respectively mounted at holes 65 on the main shafts 42, 44. Each of the preferred cutting wheels is mounted on its circular main shafts at a longitudinal groove 66 by a pair of ball bearings 68. Because of the axial width of each cutting wheel 62, 64, two ball bearings 68 are preferred for each wheel to distribute the load equally between. The ball bearings 68 are installed in the groove 66 and a pair of axially aligned detents 70 provided in the interior wall of hole 65. The detents 70 are relatively easy to provide by inserting a tool at each side of hole 65.

The cutting wheels 62 are axially separated from axially adjacent cutting wheels 62 on the shaft 42 by one of the cutting wheels 64 on the main shaft 44. The cutting wheels 62, 64 are of a design which is different from any of the cutting wheels shown in the prior art machines disclosed in the patents mentioned hereinabove. The cutting wheels include a plurality of evenly spaced cutting teeth 72 with a root diameter D. The main shafts 42, 44 are separated by a distance therebetween which is less than the root diameter D to provide an overlapping of the cutting wheels 62, 64 which includes all of the radial heights of the cutting teeth 72. Further, it should be noted that the preferred cutting teeth 72 are quite simple in form and simple to provide. Specifically, the cutting teeth 72 are identical with a flat leading surface 74 and a flat trailing surface 76 which meet at a straight edge 78 at the outer periphery of the cutting wheel which straight edge 78 is parallel to the shafts 42, 44. The cutting teeth 72 are also equally positioned at the periphery of the wheels as the leading surface 74 and trailing surface 76 intersect a radial line of the cutting wheel through the edge 78 at equal angles. It has been found that such a tooth configuration includes sufficient integrity and well-aligned cutting edges for gripping and cutting sheet plastic and sheet metal material found in disposable containers. Further, the equal positioning of the teeth 72 means that the cutting wheels 62, 64 are all interchangable and can be installed either side first on the shafts 42, 44 without affecting their effectivness. This feature reduces manufacturing costs and simplifies assembly. However, the interaction of cutting wheels 62, 64 is not expected to do the cutting alone.

The cutting section 14 also includes a plurality of combers 80 which are different from those disclosed in the prior art patents mentioned hereinabove. Each comber 80 is aligned with a corresponding cutting wheel 62, 64 to provide a gap 82 between an end 84 thereof and the cutting teeth 72 of the corresponding cutting wheel 62, 64. Basically, the combers 80 are each mounted at holes 86 on a pair of mounting rods 88 which extend across the cutting section 14. The mounting rods 88 are parallel with and located outwardly of the shafts 42, 44 to cause each comber 80 to extend around one of the shafts 42, 44 at a hole 90 therethrough and between axially adjacent cutting wheels 62, 64 on the shaft 42, 44. As a result, the end 84 of each comber 80 is located at the cutting teeth 72 of the corresponding wheel 64, 62 on the other shaft 44, 42 to provide the gap 82 therebetween. However, it has been found in the preferred machine 10 that the relatively thick comber 80 need not be made of a single, solid metal piece as is required for the cutting wheels 62, 64. To simplify manufacture of the preferred combers 80 and to make them less expensive to provide, the combers 80 have an overall thickness T less than a cutting wheel 62, 64 but are formed of a plurality of thin metal plates 92 in a stacked array to provide the overall thickness T. The plates 92 can be simply and inexpensively stamped from sheet material and may be spot welded if desired to form a more rigid comber 80.

As thus described, the cutting section 14 can be expected to properly cut disposable containers into pieces in various machine arrangements. However, in the preferred machine 10, the feeding assist means 55 is employed to insure each load of disposable containers is completely cut to pieces and to speed up machine operation. The feeding assist means 55 is in an entrance opening 94 of the cutting section 14 and includes the pair of feeding shafts 52, 54 which are centrally disposed above the pair of main shafts 42, 44 and parallel thereto. The feeding shafts 52, 54 each include a plurality of feeding paddles 96 fixedly mounted thereon. Each of the feeding shafts 52, 54 and paddles 96 thereon rotate in the same direction as its adjacent main shaft 42, 44 to cause the paddles 96 to push the disposable containers toward the cutting wheels 62, 64 to be gripped thereby. In the preferred machine 10, the shafts 52, 54 include three paddles 96, rotate at the same speed, and are rotationally aligned to cause each paddle 96 on feeding shaft 52 to pass closely by a corresponding paddle 96 on feeding shaft 54 to be able to entrap the disposable containers therebetween to facilitate the push thereon toward the cutting wheels 62, 64.

In order to fully understand the preferred machine 10, there is additional information which might be of interest. The machine 10 can cut disposable containers including ½, 1 or 2 liter plastic bottles and aluminum or steel cans. The overall height of the machine 10 is about 5½ feet tall. The preferred loading section 12 is about 22" tall with a 24"×24" top opening and a bottom about 8"×13". The preferred cutting section is just over 13" wide to include thirteen cutting wheels 62, 64. Each main shaft 42, 44 has a diameter of about 2⅜ inches. The cutting wheels 62, 64 are one inch wide and have an outside diameter of about 4¾ inches. The root diameter D is about 4¼ inches with a tooth height of ¼ inch. There are 30 evenly-spaced cutting teeth 72 with leading surface 74 being perpendicular to trailing surface 76. The two ball bearings 68 are ¼ inch and installed in two detents 70 which are ⅛ inch deep and respectively centered ¼ inch from each side of the cutting wheel 62, 64. The combers 80 have an overall thickness T of ¾ inches and are made of three ¼ inch sheets of metal. Collecting section 16 is about 2 feet by 2 feet. The pieces cut from the 2-liter plastic bottles are corrugated, about 1 inch wide in various lengths and result in a volume of about ⅓ the volume of the original bottles.

Figures 6, 7:
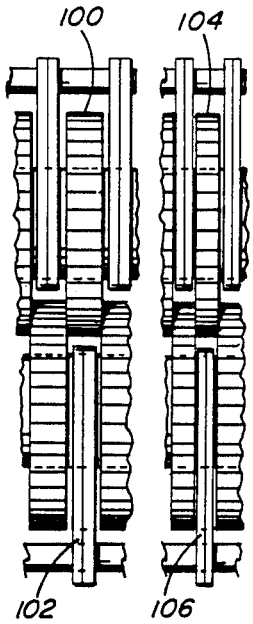
FIG. 6 is a fragmentary top view of an alternative cutting section.
FIG. 7 is a view such as shown in FIG. 6 of another alternative cutting section.

The preferred machine 10 is not the only type of machine in which the general type of components of the cutting section can be employed. For example, if there is a need for a machine at a waste disposal center requiring greater capacity and greater volume savings, the cutting wheel 100 and comber 102 arrangement of FIG. 6 can be used. The cutting wheels 100 have the same teeth and diameter as the wheels 62, 64 but are only ¾ inches wide. The combers 102 are ½ inches thick and made of two ¼ inch sheets of metal. The pieces will be only ¾ inches wide for a waste volume of about ¼ of the original volume. The overall length of such a machine could be increased to about 24 inches for a total of 32 cutting wheels 100 and 32 combers 102. Similarly, as seen in FIG. 7, similar cutting wheels 104 could be only ½ inches wide and combers 106 of about ⅜ inches in width could be formed of two 3/16 sheets of metal. The waste volume of such a machine would be about 1/5 of the original volume.

As seen in FIGS. 8 through 11, an alternative cutting machine 120 for cutting at least one disposable container at a time includes a first cutting section 122 which is similar to the cutting sections described hereinabove for the embodiments of FIGS. 1 through 7. However, the cutting machine 120 also includes a second cutting section 124 to further reduce the size of the pieces of the disposable container. The cutting machine 120 is intended to be installed in a reverse vending machine (not shown) which will be primarily utilized to allow individual consumers to return empty containers to the reverse vending machine for money or credit for the "deposit" on the container when initially bought. Consequently, the reverse vending machine will include many features which are outside the scope of the present invention. For example, there would probably be included means for insuring that only one container at a time can be placed in the reverse vending machine for cutting and that the cutting machine 120 will not function when the reverse vending machine is open or anything other than the desired container may be cut. The container would probably be "examined" by the reverse vending machine to determine that it is the right type of container, which company made it, that it is empty and in a condition for cutting, etc.. It should therefore be sufficient, for the purposes of describing the cutting machine 120, to realize that it will be employed in a manner which will insure that at least one container at a time will be directed to the first cutting section 122 thereof and that the pieces being discharged from the second cutting section 124 thereof will be collected in and periodically removed from the interior of the reverse vending machine.

The first cutting section 122 includes a first support structure 126 to be mounted within the reverse vending machine. A motor 128 is mounted on the structure 126 to drive a speed reducer 130 through a belt and pully configuration 132. The speed reducer 130 includes an output 134 to drive one of the shafts 136 having cutting wheels 138 thereon in the manner discribed hereinabove. The other shaft 136 is driven by gears 140 to produce the desired rotation in opposite directions. The first cutting section 122 would therefore include the same type of overlapping configuration of cutting wheels 138 as the previously discribed embodiments with a plurality of similar cutting teeth 142 thereon.

Additionally, the cutting section 122 includes an array of combers 144 at each side thereof which are supported on rods 146. In the same manner as described hereinabove, each comber 144 would have an inner end thereof near a corresponding cutting wheel 138 to provide a gap therebetween. As a result, when a container enters an inlet 150 of the first cutting section 122 from generally above and between the shafts 136, it is initially gripped by the cutting teeth 142 of the cutting wheels 138 and drawn therebetween to be cut into first pieces.

To insure that each container is properly directed to the inlet 150 of the first cutting section 122, a feeding assist section 152 is also included in and supported by the first support structure 126. The shafts 136 each include a sprocket and chain means 154 at the ends thereof opposite from the gears 140 in order to transmit corresponding rotation to a pair of feeding shafts 156 of the feeding assist section 152. Each of the feeding shafts 156 includes a pair of feeding paddles 158 fixedly mounted thereon. The paddles 158 again rotate in the same direction as their corresponding shafts 136 in order to be able to push the disposable container toward the cutting wheels 138 to be gripped thereby. The paddles 158 are rotationally aligned to cause each paddle 158 of one of the feeding shafts 156 to pass closely by a corresponding paddle 158 on the other feeding shaft 156 to entrap the container between extended edges 160 thereof. The alternative paddles 158 differ from the paddles 96 of the embodiment of FIGS. 1 through 5 in the form and shape provided to the extended edges 160. Specifically, the extended edges 160 are provided a plurality of teeth 162 and are angled toward the direction of rotation from the radial portion of the paddles. The angle A provided to the edges 160 insures better entrapment of the container. Similiarly, the teeth 162 reduce the likelihood of the container slipping from between the paddles 158 as it is directed downwardly to the inlet 150.

Because of the intended use of the cutting machine 120 in a reverse vending machine, it is important that the pieces cut thereby take up as little space as possible. In other words, where it is important to reduce the overall space that the pieces cut from each container will fill, it is desirable to insure that each individual piece is as small as practical. If the pieces are small, they will tend to lay closer together to produce a greater mass of the container material in the same space than would larger pieces.

Accordingly, to increase the number of cut containers which can be retained in the reverse vending machine prior to periodic removal, the alternative machine 120 includes a second cutting section 124. The second cutting section 124 includes a second support structure 162 with support tabs 164 at a back edge thereof and mounting holes and brackets 165 at the forward edge thereof to allow it to be mated with and supported by the first support structure 126. As will be seen, providing the first support structure 126 and the second support structure 162 in this manner allows the machine 120 to be conveniently shipped and assembled and, further, facilitates disassembly for separate maintenance and cleaning of the first cutting section 122 and the second cutting section 124.

The second support structure 162 includes a motor 166 mounted thereon with an associated pulley and belt configuration 167 to drive a cutting blade shaft 168. The second cutting section 124 includes a fixed cutting blade 170 rigidly mounted in the structure 162 and a pair of rotating cutting blades 172 mounted on the cutting blade shaft 168. Each of the blades 170, 172 are individually adjustable and aligned to cut the first, elongated pieces discharged from the cutting section 122 into smaller, second pieces. Although not shown in detail in the Figures, the fixed blade 170, which is generally aligned tangentially to the blades 172 rotating thereby, is provided a leading cutting edge 174 which is slightly angled with respect to the shaft 168 and the blades 172 mounted thereon. As a result, the cutting edge 174 will be in close cutting relationship with the cutting edge of each blade 172 at different times along its length. This arrangement produces a scissor type cutting of the first pieces rather than a simple chopping. The preferred method of cutting in the second cutting section 124 is quieter and results in less wear and vibration which should increase the effective life of the second cutting section 124.

The preferred close proximity of the first cutting section 122 and the second cutting section 124 insures that the first pieces will be properly supported and directed to the second cutting section 124 by the first cutting section 122. Because the first pieces are elongated strips of container material, the rearward ends thereof will still be located within the gap between the combers 146 and their corresponding cutting wheels 138 as the forward end of each first piece is being cut into smaller second pieces by the cutting section 124. As a result, even though a part of each first piece will be released from the first cutting section 122 before it can be received for further cutting in the second cutting section 124, the systematic support of the first pieces as they are initially being cut in the second cutting section 124 insures that the second cutting section 124 will be able to cut and discharge the smaller second pieces at a sufficient rate. The first pieces will not be able to collect or gather above the second cutting section 124 and interfere with its cutting function.

To further insure that all the first elongated pieces are directed between the blades 170, 172, a circumferential shield or guide plate 176 is provided behind the rotating blades 172 to prevent the first pieces or portion thereof from collecting elsewhere in the second cutting section 124. Additionally, the second cutting section 124, because of the particular reverse vending machine in which it is to be employed, includes an outlet deflector 178. The outlet deflector 178 is intended to roughly separate the second pieces for receipt and collection in two collection areas for easy removal from the reverse vending machine.

In order to better understand the machine 120, it is appropriate to include some dimensions and operating specifications of the preferred machine 120. For example, the preferred machine 120 can be used in a reverse vending machine adapted and designed to control and regulate the deposit of ½-, 1-, 2-, and/or 3-liter plastic bottles therein. To properly cut these types of plastic bottles, the motor for the first cutting section is two HP, the speed reduction is 25 to 1, and the cutting wheels rotate at about 34 RPM. To ensure that all the bottles will be properly fed to the cutting wheels, the angle A of the edge of the feeding paddle should be between 10 to 25 degrees. An angle A of 19 degrees is used in the preferred machine. As with one of the embodiments described hereinabove, each of the cutting wheels includes 30 cutting teeth and is about ½ inch wide. Consequently, it is expected that the first pieces discharged from the first cutting section would fill a space about 1/5th the space required for the bottles prior to cutting.

The second cutting section is driven by a 1-Hp motor to cause the cutting blade shaft to rotate at about 772 rpm or about 20 to 25 times faster than the shafts of the first cutting section. Each of the rotating blades is about $\frac{1}{2}'' \times 1\frac{1}{2}'' \times 7\frac{7}{8}''$. The designed taper or tilt of the fixed blade is about $\frac{1}{8}''$ along its length. The second pieces are cut from the first pieces by the second cutting section to fill a space about 1/10th to 1/12th the space required for the bottles prior to cutting. It has been determined that fifty plastic bottles can be reduced in volume to fill a one cubic foot space.

Clearly, any number of alternatives could be made to the preferred machines without departing from the scope of the invention as claimed.

We claim:

1. A method of cutting at least one disposable container such as a plastic bottle or metal can comprising the steps of:

entrapping said container between opposed members moving in a first direction toward oppositely rotating sets of overlapping cutting wheels to feed said container in said first direction between said oppositely rotating sets of said overlapping cutting wheels;

gripping said container between cutting teeth of said oppositely rotating sets of said overlapping cutting wheels;

cutting said container in said first direction into first pieces between said cutting teeth of said overlapping cutting wheels;

retaining said first pieces adjacent said cutting teeth until fully cut from said container thereby; and cutting said first pieces in a second direction transverse to said first direction to produce smaller second pieces during said retaining of said first pieces.

2. The method as set forth in claim 1, including collecting a plurality of said containers to allow simultaneous said feeding of several of said containers.

3. The method as set forth in claim 2, including simultaneous said cutting of several of said containers.

4. The method as set forth in claim 1, wherein said entrapping includes localized gripping between a plurality of gripping teeth on said opposed members.

* * * * *